US011747087B2

(12) United States Patent
Gibson et al.

(10) Patent No.: US 11,747,087 B2
(45) Date of Patent: Sep. 5, 2023

(54) HOUSEHOLD APPLIANCE INCLUDING REFLECTIVE DOOR

(71) Applicants: BSH Home Appliances Corporation, Irvine, CA (US); BSH Hausgeräte GmbH, Munich (DE)

(72) Inventors: John Gibson, Pollocksville, NC (US); Kenneth Jones, Washington, NC (US); Robert Parchman, Newport, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/142,282

(22) Filed: Jan. 6, 2021

(65) Prior Publication Data

US 2022/0214111 A1 Jul. 7, 2022

(51) Int. Cl.

| | |
|---|---|
| ***F27D 21/02*** | (2006.01) |
| ***F24C 15/00*** | (2006.01) |
| ***F24C 15/04*** | (2006.01) |
| ***F27D 1/00*** | (2006.01) |
| *F24C 7/08* | (2006.01) |

(52) U.S. Cl.

CPC ..... *F27D 21/02* (2013.01); *F24C 15/008* (2013.01); *F24C 15/04* (2013.01); *F27D 1/0033* (2013.01); *F24C 7/085* (2013.01); *F24C 15/005* (2013.01); *F27D 2021/026* (2013.01)

(58) Field of Classification Search

CPC ..... F24C 15/008; F24C 15/04; F24C 15/005; F24C 7/085; F27D 1/0033; F27D 21/02; F27D 2021/026

USPC ..... 126/200

See application file for complete search history.

(56) References Cited

U.S. PATENT DOCUMENTS

| | | | | |
|---|---|---|---|---|
| 5,830,529 | A | 11/1998 | Ross | |
| 6,024,084 | A * | 2/2000 | Gerhardinger | C03C 17/3417 126/200 |
| 10,024,544 | B2 | 7/2018 | Bbogal et al. | |
| 10,398,260 | B2 | 9/2019 | Park et al. | |
| 2003/0066825 | A1 | 4/2003 | Leutner | |
| 2012/0076351 | A1 | 3/2012 | Yoon | |

(Continued)

FOREIGN PATENT DOCUMENTS

JP 2000220845 A 8/2000

OTHER PUBLICATIONS

International Search Report PCT/EP2021/084779 dated Mar. 24, 2022.

*Primary Examiner* — Steven B McAllister
*Assistant Examiner* — Benjamin W Johnson
(74) *Attorney, Agent, or Firm* — Michael E. Tschupp; Brandon G. Braun; Andre Pallapies

(57) ABSTRACT

Household appliances may include partially reflective (e.g., one-way mirror) glass as part of an oven door. The partially reflective glass may transmit light from an interior of the household appliance and may reflect light from outside the household appliance. Accordingly, one can see into the lighted interior but a camera inside the interior cannot see out through the door. In some examples, the household appliance includes a lamp and a camera disposed within the cavity of the appliance. The lamp and the camera are interlocked to protect user privacy by activating the one-way feature of the door glass as needed.

18 Claims, 5 Drawing Sheets

(56) References Cited

U.S. PATENT DOCUMENTS

| | | | | |
|---|---|---|---|---|
| 2013/0008318 | A1* | 1/2013 | McPherson | F24C 15/04 99/341 |
| 2015/0330640 | A1 | 11/2015 | Stork et al. | |
| 2017/0115008 | A1* | 4/2017 | Erbe | F24C 7/081 |
| 2018/0220500 | A1 | 8/2018 | Staton | |
| 2019/0382941 | A1* | 12/2019 | Hwang | G06N 20/00 |
| 2020/0003428 | A1* | 1/2020 | Kondo | H05B 6/6444 |
| 2021/0360203 | A1 | 11/2021 | Bauer | |
| 2022/0021865 | A1 | 1/2022 | Luckhardt | |

* cited by examiner

HOUSEHOLD APPLIANCE INCLUDING REFLECTIVE DOOR

FIELD

This disclosure relates to systems and methods for household appliances. More specifically, the disclosed embodiments relate to smart ovens including cameras.

INTRODUCTION

Household appliances, such as kitchen appliances, are increasingly including "smart" features, which use computer-implemented systems and methods to increase functionality. Household appliances may include a variety of features intended to improve appliance usability, such as app integration, remote controls, cameras, internet connectivity, or other computer-implemented features. However, smart appliances may introduce privacy concerns, especially when the appliances include cameras or are connected to the internet. Smart appliances must therefore balance improvements in technology with user privacy.

SUMMARY

The present disclosure provides systems, apparatuses, and methods relating to camera-enabled appliances (e.g., ovens).

In some embodiments, a household appliance of the present disclosure includes: a housing defining an oven cavity; a door pivotably coupled to the housing such that the door is configured to open and close an opening to the cavity, the door including a window comprising partially reflective glass; a camera coupled to an inner wall of the housing inside the oven cavity such that the camera faces the opening; and a lamp disposed within the oven cavity and configured to illuminate the oven cavity; wherein the lamp and the camera are interlocked such that the camera is operable only when the lamp illuminates the oven cavity.

In some embodiments, a household appliance of the present disclosure includes: a housing defining an oven cavity and including a door pivotably coupled to a front surface of the housing such that the door is configured to selectively open and close the cavity; a window disposed in the door, the window comprising partially reflective glass configured to reflect light traveling out of the cavity into a surrounding room and to transmit light traveling into the cavity from the surrounding room; a camera disposed within the oven cavity; and a light configured to illuminate the oven cavity; wherein the camera and the light are interlocked such that the camera is only powered when the light is powered.

In some embodiments, a household appliance of the present disclosure includes: a housing defining an oven cavity; a door pivotably coupled to a front surface of the housing and configured to obscure an opening of the oven cavity when the door is in a closed configuration; a window received within a recess disposed within the door, the window comprising partially reflective glass configured to reflect light traveling in a first direction and transmit light traveling in a second direction; a camera disposed within the oven cavity; a light configured to illuminate the oven cavity; and a controller configured to activate the camera only if the household appliance is on, the door of the household appliance is closed, and the light is on.

Features, functions, and advantages may be achieved independently in various embodiments of the present disclosure, or may be combined in yet other embodiments, further details of which can be seen with reference to the following description and drawings.

DETAILED DESCRIPTION

Figure 1:
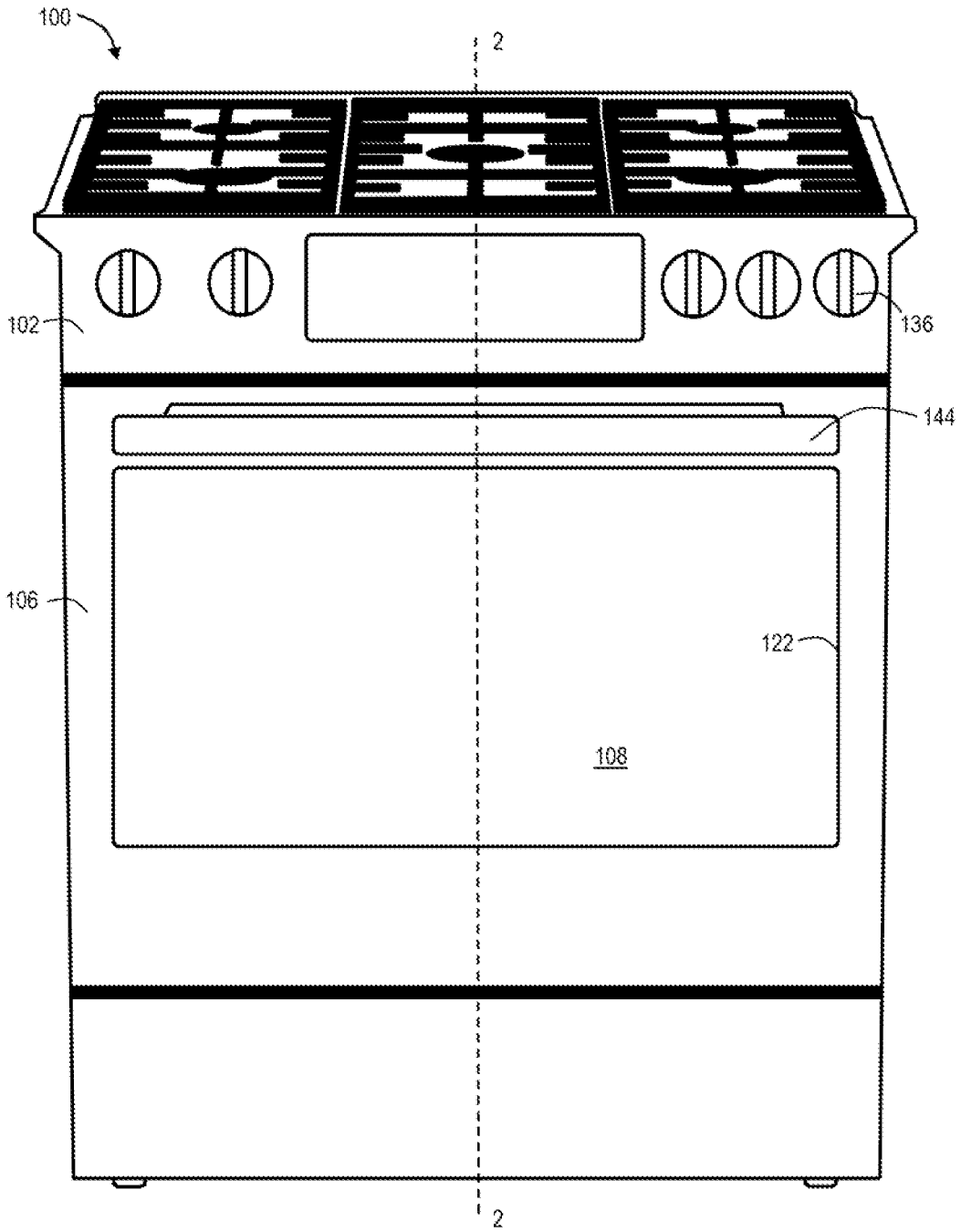
FIG. 1 is a schematic diagram of an illustrative household appliance in accordance with aspects of the present disclosure.

Various aspects and examples of household appliances including reflective doors, as well as related methods, are described below and illustrated in the associated drawings. Unless otherwise specified, a household appliance in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Coupled" means connected, either permanently or releasably, whether directly or indirectly through intervening components.

"Processing logic" describes any suitable device(s) or hardware configured to process data by performing one or more logical and/or arithmetic operations (e.g., executing coded instructions). For example, processing logic may include one or more processors (e.g., central processing units (CPUs) and/or graphics processing units (GPUs)), microprocessors, clusters of processing cores, FPGAs (field-programmable gate arrays), artificial intelligence (AI) accelerators, digital signal processors (DSPs), and/or any other suitable combination of logic hardware.

A "controller" or "electronic controller" includes processing logic programmed with instructions to carry out a controlling function with respect to a control element. For example, an electronic controller may be configured to receive an input signal, compare the input signal to a selected control value or setpoint value, and determine an output signal to a control element (e.g., a motor or actuator) to provide corrective action based on the comparison. In another example, an electronic controller may be configured to interface between a host device (e.g., a desktop computer, a mainframe, etc.) and a peripheral device (e.g., a memory device, an input/output device, etc.) to control and/or monitor input and output signals to and from the peripheral device.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

"Providing," in the context of a method, may include receiving, obtaining, purchasing, manufacturing, generating, processing, preprocessing, and/or the like, such that the object or material provided is in a state and configuration for other steps to be carried out.

A "transparent" material is at least partially transmissive with respect to the electromagnetic radiation in question, such as visible light, ultraviolet light, infrared light, etc. In some examples, a transparent object allows the passage of light through the object without appreciable distortion. A "semi-transparent" material is generally understood to transmit less light than materials described as transparent.

Overview

In general, a household appliance (e.g., an oven) in accordance with the present teachings includes an oven housing defining an oven cavity, the oven housing including a reflective door pivotably coupled to a front edge of the oven housing. The reflective door is configured to allow access to the oven cavity when opened, and, when closed, to obscure the oven cavity and retain heat within the oven. Generally, oven doors include windows received within recesses of the oven doors, which allow a user of the household appliance to view food or other objects as they are heated. The windows of the present disclosure comprise one or more pieces of partially reflective glass, and are configured to reflect light from within the oven toward a back wall of the oven.

In some examples, the glass is coated with a partially reflective (AKA one-way mirrored, two-way mirrored) coating. In some examples, the glass includes reflective coating applied only to an inner surface of the window. In some examples, the window includes a greater amount of coating (e.g., a thicker coating layer) on an inside surface of the window and comparatively less coating (e.g., a thinner coating layer) on an outside surface of the window.

Household appliances of the present teachings are configured to be components of a "smart" appliance system including the appliance, an external device, and a server. The household appliance is networked, such that the appliance is operable from a remote location (e.g., using a smart phone). The household appliance includes a plurality of components controlled by one or more controllers and/or processors configured to be operable by a user of the household appliance, e.g., using a smart phone. In some examples, components of the household appliance are connected by circuitry to integrated power circuits, such that one component cannot function without another component being powered.

Household appliances of the present disclosure include a reflective door and a camera disposed within the appliance (e.g., oven) cavity. The camera is disposed on a wall of the oven housing (e.g., a back wall), which facilitates reduced wiring complexity within the oven. When the camera is disposed on a back wall of the oven housing, the camera is pointed toward the oven door, and therefore pointed toward the oven window and out into the surrounding room. Accordingly, without reflective coatings, including a camera within the oven cavity can infringe on the privacy of people in the surrounding space as they go about their business. Specifically, the camera is able to capture images from inside the room where the household appliance is located. When the household appliance includes a reflective door, the camera is able to capture images from within the oven cavity but prevented from capturing images from outside the oven (i.e., through the window).

In some examples, the household appliance includes a light (e.g., an oven light) disposed within the cavity. The oven light illuminates the oven cavity, which allows a user to see objects within the oven, and also causes the window to be reflective as viewed from inside the cavity. This prevents light and/or images from outside the household appliance from being visible on the camera. One-way mirrored surfaces generally transmit far less of an amount (e.g., around 30%) of light between the two sides of the mirrored surface and reflect the remaining far greater amount (e.g., 70%) of light. Where one side of the mirror is brightly lit and one side of the mirror is darkened: within the brightly lit space, reflected light (from the brightly lit side) has a much higher intensity than transmitted light from the darkened side. Transmitted light from the darkened side is nearly indistinguishable (e.g., because of contrast and/or glare) from the light reflected from the brightly lit side. This gives the appearance of a normal mirror when viewed from the brightly lit side and the appearance of a window when viewed from the darkened side. As the inside of the cavity is more brightly lit than the space outside the appliance when the light is on, ensuring the light is on when the camera is on facilitates the protection of privacy in the surrounding space. Specifically, with the light on, the camera will see the window as a reflective surface.

In some examples, the camera and the oven light are powered by the same power source, such that activating the camera always activates the oven light. In some examples, respective power sources of the camera and oven light are controlled by a same electronic controller and/or computer process, such that the controller of the computer system activates the camera and the oven light simultaneously. In some examples, the oven light may be capable of being activated while the camera is off.

Aspects of household appliances including reflective doors (e.g., a controller) may be embodied as a computer method, computer system, or computer program product. Accordingly, aspects of the household appliance may take the form of an entirely hardware embodiment, an entirely software embodiment (including firmware, resident software, micro-code, and the like), or an embodiment combining software and hardware aspects, all of which may generally be referred to herein as a "circuit," "module," or "system." Furthermore, aspects of the household appliance may take the form of a computer program product embodied in a computer-readable medium (or media) having computer-readable program code/instructions embodied thereon.

Any combination of computer-readable media may be utilized. Computer-readable media can be a computer-readable signal medium and/or a computer-readable storage medium. A computer-readable storage medium may include an electronic, magnetic, optical, electromagnetic, infrared, and/or semiconductor system, apparatus, or device, or any suitable combination of these. More specific examples of a computer-readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, and/or any suitable combination of these and/or the like. In the context of this disclosure, a computer-readable storage medium may include any suitable non-transitory, tangible medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, and/or any suitable combination thereof. A computer-readable signal medium may include any computer-readable medium that is not a computer-readable storage medium and that is capable of communicating, propagating, or transporting a program for use by or in connection with an instruction execution system, apparatus, or device.

Program code embodied on a computer-readable medium may be transmitted using any appropriate medium, including but not limited to wireless, wireline, optical fiber cable, RF, and/or the like, and/or any suitable combination of these.

Computer program code for carrying out operations for aspects of household appliances including reflective doors may be written in one or any combination of programming languages, including an object-oriented programming language (such as Java, C++), conventional procedural programming languages (such as C), and functional programming languages (such as Haskell). Mobile apps may be developed using any suitable language, including those previously mentioned, as well as Objective-C, Swift, C#, HTML5, and the like. The program code may execute entirely on a user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), and/or the connection may be made to an external computer (for example, through the Internet using an Internet Service Provider).

Aspects of the household appliance may be described below with reference to flowchart illustrations and/or block diagrams of methods, apparatuses, systems, and/or computer program products. Each block and/or combination of blocks in a flowchart and/or block diagram may be implemented by computer program instructions. The computer program instructions may be programmed into or otherwise provided to processing logic (e.g., a processor of a general purpose computer, special purpose computer, field programmable gate array (FPGA), or other programmable data processing apparatus) to produce a machine, such that the (e.g., machine-readable) instructions, which execute via the processing logic, create means for implementing the functions/acts specified in the flowchart and/or block diagram block(s).

Additionally or alternatively, these computer program instructions may be stored in a computer-readable medium that can direct processing logic and/or any other suitable device to function in a particular manner, such that the instructions stored in the computer-readable medium produce an article of manufacture including instructions which implement the function/act specified in the flowchart and/or block diagram block(s).

The computer program instructions can also be loaded onto processing logic and/or any other suitable device to cause a series of operational steps to be performed on the device to produce a computer-implemented process such that the executed instructions provide processes for implementing the functions/acts specified in the flowchart and/or block diagram block(s).

Any flowchart and/or block diagram in the drawings is intended to illustrate the architecture, functionality, and/or operation of possible implementations of systems, methods, and computer program products according to aspects of the household appliance In this regard, each block may represent a module, segment, or portion of code, which comprises one or more executable instructions for implementing the specified logical function(s). In some implementations, the functions noted in the block may occur out of the order noted in the drawings. For example, two blocks shown in succession may, in fact, be executed substantially concurrently, or the blocks may sometimes be executed in the reverse order, depending upon the functionality involved. Each block and/or combination of blocks may be implemented by special purpose hardware-based systems (or combinations of special purpose hardware and computer instructions) that perform the specified functions or acts.

EXAMPLES, COMPONENTS, AND ALTERNATIVES

The following sections describe selected aspects of illustrative household appliances having reflective doors, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Household Appliance

Figure 2:
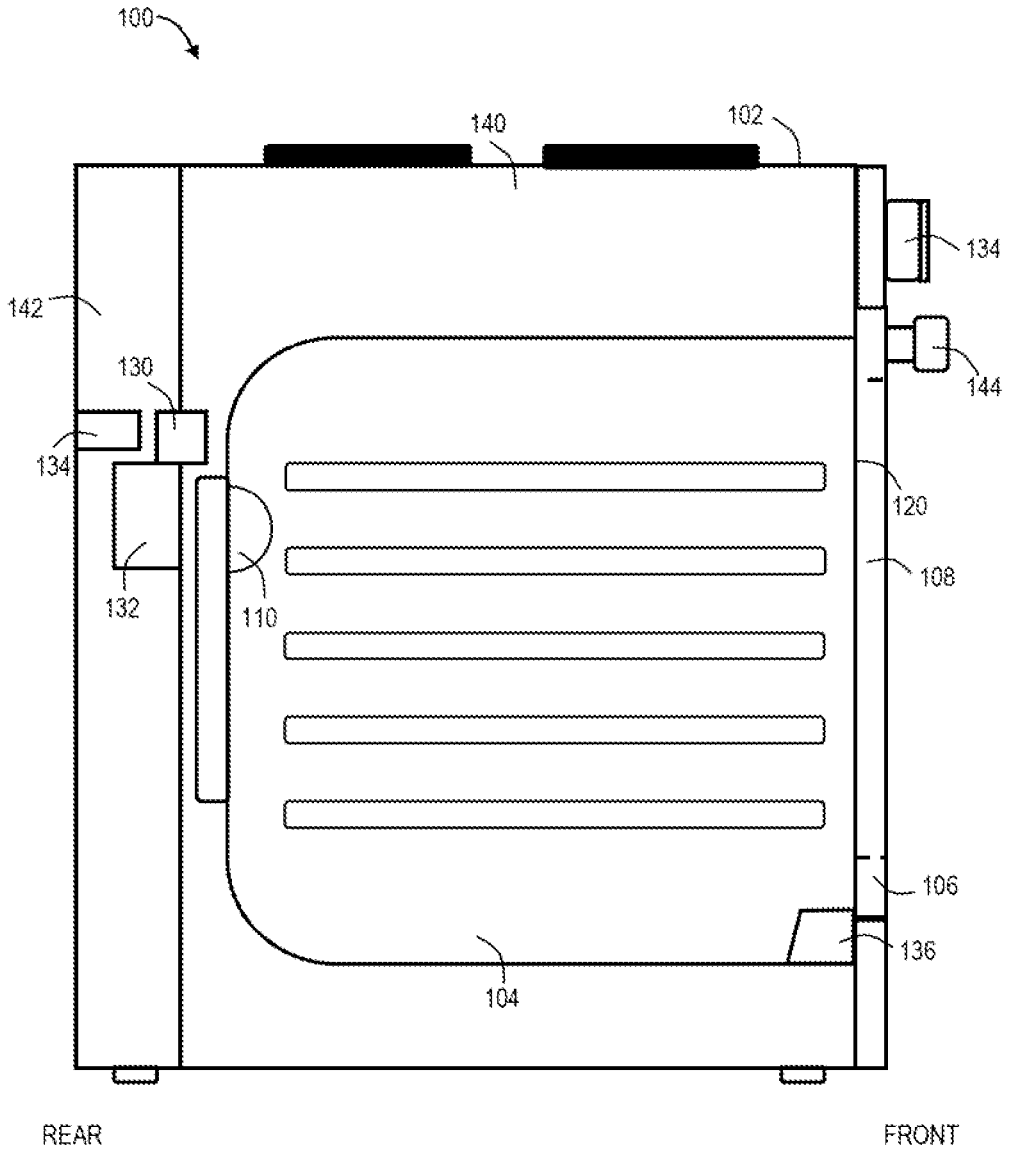
FIG. 2 is a schematic sectional view of the illustrative household appliance of FIG. 1, taken at 2-2 of FIG. 1.

As shown in FIGS. 1 and 2, this section describes an illustrative household appliance 100. Household appliance (e.g., oven or range) 100 includes appliance cavity 104 (e.g., oven cavity) and an appliance housing 102 external to the appliance cavity. Although a cooktop and oven are depicted, other suitable appliances may be utilized (e.g., microwave ovens, toaster ovens, etc.).

Housing 102 defines an upper compartment 140 disposed above the oven cavity, which may be configured to contain circuitry and/or piping associated with burner function, broiler function, and/or any suitable hardware associated with appliance functions. The housing further defines a rear compartment 142 disposed behind the oven cavity, which is configured in some examples to provide an air source for burners associated with the household appliance and to contain any suitable circuitry and/or hardware. The upper compartment and the rear compartment are separated by an interior wall of housing 102.

Housing 102 includes an opening 120 in a front surface to allow oven cavity access. The housing may further include a door 106 pivotably coupled by hinges to the front surface of the housing, such that the door is configured to selectively open and close the opening of the cavity. Door 106 may include a handle 144 disposed on a front surface. In some examples, appliance 100 includes controls 134 disposed on a front surface of housing 102. Controls 134 may include a plurality of user-interface features such as knobs, buttons, touch screens, and/or the like, which may enable a user to control and/or adjust a variety of appliance settings associated with appliance function. In some examples, controls 134 control oven temperature, bake time, oven light function, and/or any other suitable functionality.

Door 106 includes a window 108 disposed in the door (e.g., received within an opening or recess 122). Window 108 comprises partially reflective glass (AKA one-way mirrored and/or semi-transparent), configured to reflect light traveling in a first direction and transmit light traveling in a second direction. Window 108 may comprise glass coated on one or both sides with any suitable partially reflective coating, such as aluminum coating, window film, and/or the like. In some examples, the partially reflective coatings are configured to be resistant to off-gassing and to be non-flammable. In some examples, window 108 includes a coating disposed only on an inner surface of the glass (i.e., on the side disposed within the appliance cavity). In some examples, window 108 includes a coating disposed on both an inside and an outside surface of the glass. In some examples, window 108 includes a greater amount of coating (e.g., thicker, denser, etc.) disposed on an inside surface of the glass than on an outside surface of the glass. In some examples, a first side of the window includes a partially reflective coating applied in a first layer thickness, a second side of the window includes a partially reflective coating applied in a second layer thickness, and the second layer thickness is less than the first layer thickness.

Partially reflective glass transmits light from a more brightly lit side of the glass to a darkened side of the glass. In other words, light is transmitted based on a light differential. In some examples, for partially reflective glass to be effective, between the brightly lit or lighted side and the darkened side, a multiple of six to ten times is sufficient. Accordingly, household appliance 100 includes a light 110 disposed within appliance cavity 104, which illuminates the appliance cavity. Light 110 may comprise any lamp suitable for illuminating a high-heat area, such as light emitting diode (LED) lamps, incandescent lamps, and/or the like. As the appliance cavity is generally better lit than a surrounding area when the light is illuminated, light from within the appliance cavity is transmitted through the partially reflective glass to surrounding areas outside of the appliance cavity. A user of the household appliance may therefore observe food or other objects within the appliance through window 108 by turning on the light. In some examples, the partially reflective glass utilized in the window of household appliance 100 may improve heat retention within the oven cavity.

Household appliance 100 includes a camera 130 disposed within appliance cavity 100. Camera 130 is configured to record images of the interior of the appliance cavity, and an object (e.g., food, cooking utensil, etc.) disposed within the cavity. In this example, camera 130 is mounted to a back wall of housing 102, and is electrically coupled to wiring disposed within rear compartment 142. Camera 130 faces toward window 108.

Camera 130 is electrically coupled to a controller 132 of the camera disposed within rear compartment 142. In some examples, camera 130 is electrically coupled and/or interlocked to light 110, and the two components are controlled by a same power supply 134. In these examples, camera 130 is only powered if and when light 110 is illuminating the appliance cavity. In some examples, camera 130 and light 110 are controlled by controller 132, and the controller switches off camera 130 in response to a user switching off light 110. In some examples, appliance 100 includes a door position sensor 136 electrically coupled to camera 130. Door position sensor 136 senses whether door 106 is open or closed. In some examples, door position sensor 136 is coupled to housing 102. In some examples, door position sensor 136 is coupled to door 106. In some examples, door position sensor is electrically coupled to camera 130 and must sense that the door is closed for the camera to be switched on. In some examples, the light and the camera are powered or enabled/disabled through a same switch.

B. Illustrative Controller Method

In some examples, controllers of household appliances according to aspects of the present disclosure (e.g., controller 132) execute method steps that include determining whether the camera is switched on and/or powered. These steps may be executed in response to a command or instruction given by a user of the household appliance to activate the camera (e.g., using controls disposed on a front surface of the household appliance, using an app installed on a portable device, etc.) This section describes steps of an illustrative method 200 for determining if a camera included in a household appliance should be switched on and/or powered; see FIG. 3. Aspects of household appliance 100 may be utilized in the method steps described below. Where appropriate, reference may be made to components and systems that may be used in carrying out each step. These references are for illustration, and are not intended to limit the possible ways of carrying out any particular step of the method.

Figure 3:
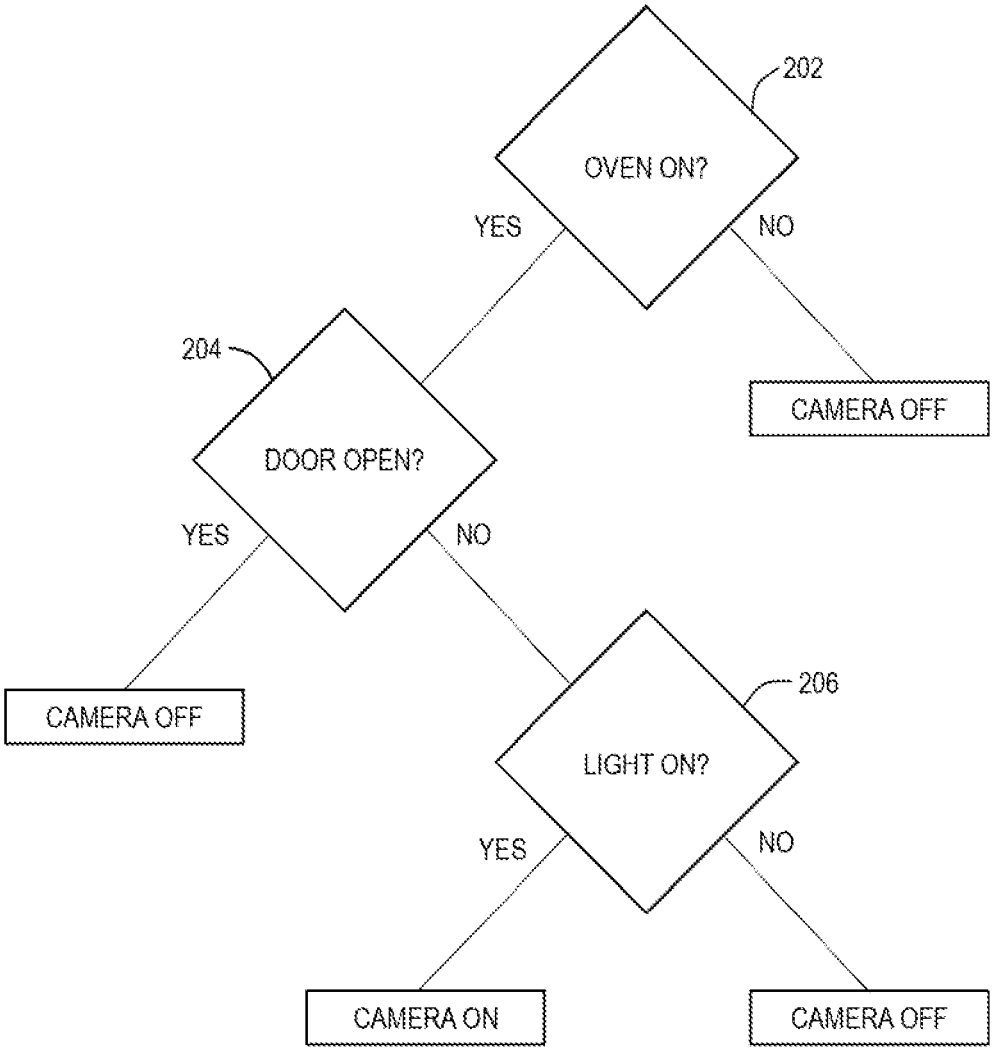
FIG. 3 is a flow chart depicting steps of an illustrative controller-implemented method of operation of a household appliance according to the present teachings.

FIG. 3 is a flowchart illustrating steps performed in an illustrative method, and may not recite the complete process or all steps of the method. Although various steps of method 200 are described below and depicted in FIG. 3, the steps need not necessarily all be performed, and in some cases may be performed simultaneously or in a different order than the order shown.

At step 202 of method 200, the controller determines if the household appliance or oven is powered and/or in an "on" state (e.g., switched on). In some examples, determining if the household appliance is on includes receiving information from a secondary controller or computer system which controls appliance function. In some examples, the controller is only powered when the household appliance is on, and step 202 includes initializing the controller at appliance startup. If the household appliance is determined by the controller to be switched off, the camera remains unpowered and/or switched off.

In some examples, the controller instructs a human-machine interface (HMI) (e.g., a screen disposed on a front surface of the household appliance, an app installed on a portable device, etc.) to alert a user that the household appliance is switched off. The user may then utilize the HMI and/or other controls coupled to the household appliance to power the household appliance and restart the controller-implemented method. If the household appliance is determined by the controller to be switched on, the method proceeds to the following step.

At step 204 of method 200, the controller determines if the door of the household appliance is open. In some examples, determining if the door of the appliance is open includes receiving information from a door position sensor or proximity switch (e.g., door position sensor 136). In some examples, determining if the door of the appliance is open includes determining if the door is latched in a closed position (e.g., using a sensor coupled to a door latch). If the door is determined by the controller to be open, the camera remains unpowered and/or switched off. In some examples, the controller instructs a human-machine interface (e.g., a screen disposed on a front surface of the household appliance, an app installed on a portable device, etc.) to alert a user that the door of the appliance is open. The user may then close the door and restart the controller-implemented method. If the door is determined to be closed, the method proceeds to the following step.

At step 206 of method 200, the controller determines if a light disposed within an oven cavity (e.g., light 110) is on. In some examples, determining if the light is on includes determining if the light is receiving power from a power source. In some examples, determining if the light is on includes receiving information from a secondary controller or computer system which controls appliance function. In some examples, the light and the camera are powered by a same power supply, such that the camera is unpowered, and therefore cannot be turned on, while the light is switched off. In some examples, determination of the status of the light is made empirically, using a light sensor disposed within the appliance cavity, e.g., including a photo-emissive cell, a photo-conductive cell, a photovoltaic cell, and/or a photo-junction device. This may facilitate detection, for example, of a burned-out lamp even if the light is powered and in an "on" state.

If the light is determined by the controller to be off, the camera remains unpowered and/or switched off. In some examples, the controller instructs a human-machine interface (e.g., a screen disposed on a front surface of the household appliance, an app installed on a portable device, etc.) to alert a user that the door of the appliance is open. The user may then utilize the human-machine interface and/or other controls coupled to the household appliance to switch on and/or power the light and restart the controller-implemented method. If the light is determined by the controller to be on, the controller powers on and/or switches on the camera, or enables the same.

In some examples, the camera of the system is in an unpowered and/or off state by default, and any change to that state requires one or more criteria to be satisfied. For example, the camera may be prevented from powering up and/or turning on and/or transmitting if the door is open, the interior light is off, or both. One or more aspects of this interlock system may be implemented via hardware.

C. Illustrative Data Processing System

Figure 4:
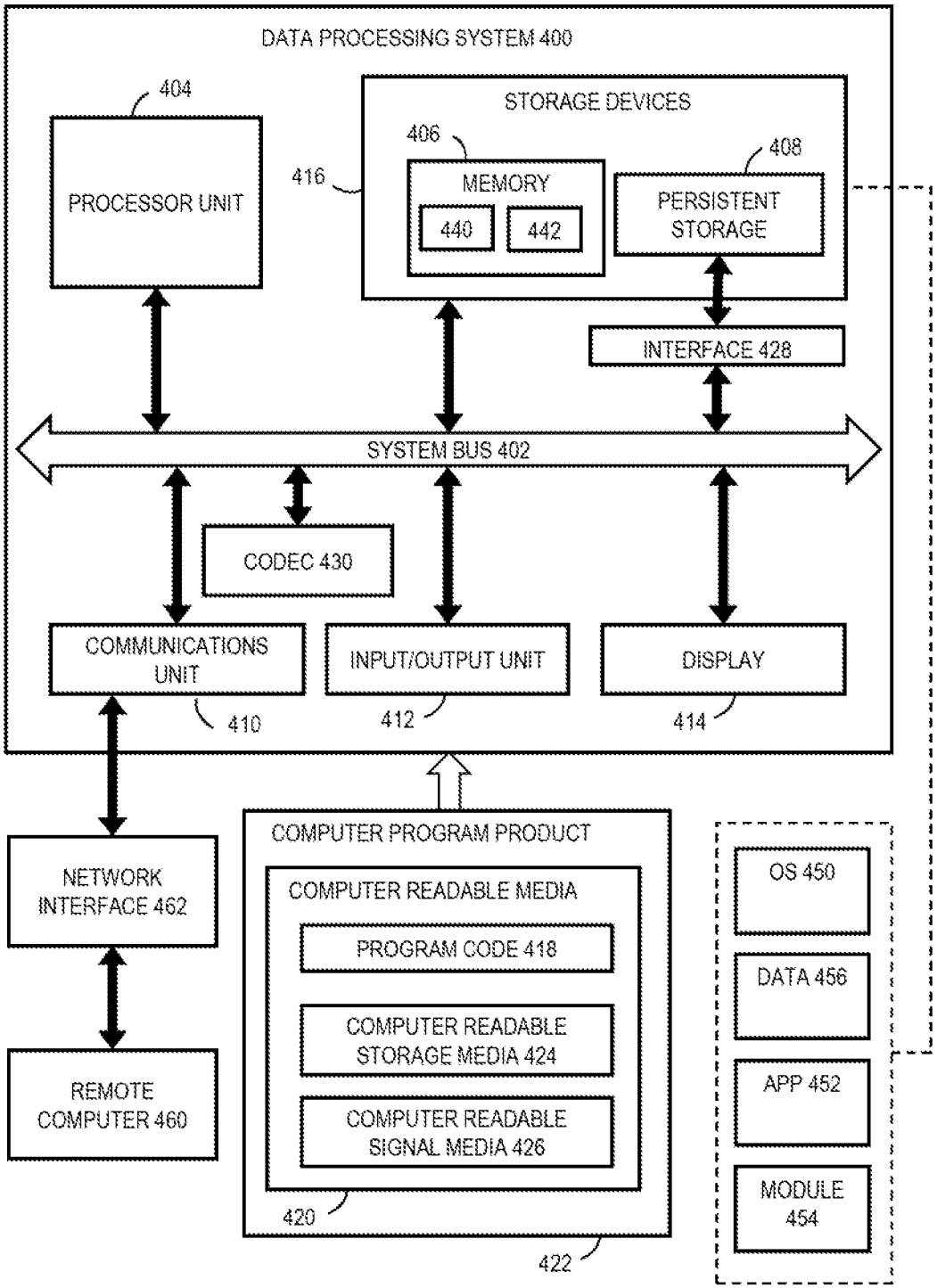
FIG. 4 is a schematic diagram depicting a data processing system in accordance with aspects of the present disclosure.

As shown in FIG. 4, this example describes a data processing system 400 (also referred to as a computer, computing system, and/or computer system) in accordance with aspects of the present disclosure. In this example, data processing system 400 is an illustrative data processing system suitable for implementing aspects of the household appliance including a reflective door. More specifically, in some examples, devices that are embodiments of data processing systems (e.g., smartphones, tablets, personal computers) may be utilized to instruct controllers described above. For examples, data processing system 400 may be included in a "smart" home system, and may be utilized to communicate with home appliance systems described above, thereby controlling functions of cameras included therein. In some examples, data processing system 400 may be configured to instruct a "smart" appliance, which may be configured to prepare food items in response to data received from an integrated camera.

In this illustrative example, data processing system 400 includes a system bus 402 (also referred to as communications framework). System bus 402 may provide communications between a processor unit 404 (also referred to as a processor or processors), a memory 406, a persistent storage 408, a communications unit 410, an input/output (I/O) unit 412, a codec 430, and/or a display 414. Memory 406, persistent storage 408, communications unit 410, input/output (I/O) unit 412, display 414, and codec 430 are examples of resources that may be accessible by processor unit 404 via system bus 402.

Processor unit 404 serves to run instructions that may be loaded into memory 406. Processor unit 404 may comprise a number of processors, a multi-processor core, and/or a particular type of processor or processors (e.g., a central processing unit (CPU), graphics processing unit (GPU), etc.), depending on the particular implementation. Further, processor unit 404 may be implemented using a number of heterogeneous processor systems in which a main processor is present with secondary processors on a single chip. As another illustrative example, processor unit 404 may be a symmetric multi-processor system containing multiple processors of the same type.

Memory 406 and persistent storage 408 are examples of storage devices 416. A storage device may include any suitable hardware capable of storing information (e.g., digital information), such as data, program code in functional form, and/or other suitable information, either on a temporary basis or a permanent basis.

Storage devices 416 also may be referred to as computer-readable storage devices or computer-readable media. Memory 406 may include a volatile storage memory 440 and a non-volatile memory 442. In some examples, a basic input/output system (BIOS), containing the basic routines to transfer information between elements within the data processing system 400, such as during start-up, may be stored in non-volatile memory 442. Persistent storage 408 may take various forms, depending on the particular implementation.

Persistent storage 408 may contain one or more components or devices. For example, persistent storage 408 may include one or more devices such as a magnetic disk drive (also referred to as a hard disk drive or HDD), solid state disk (SSD), floppy disk drive, tape drive, Jaz drive, Zip drive, flash memory card, memory stick, and/or the like, or any combination of these. One or more of these devices may be removable and/or portable, e.g., a removable hard drive. Persistent storage 408 may include one or more storage media separately or in combination with other storage media, including an optical disk drive such as a compact disk ROM device (CD-ROM), CD recordable drive (CD-R Drive), CD rewritable drive (CD-RW Drive), and/or a digital versatile disk ROM drive (DVD-ROM). To facilitate connection of the persistent storage devices 408 to system bus 402, a removable or non-removable interface is typically used, such as interface 428.

Input/output (I/O) unit 412 allows for input and output of data with other devices that may be connected to data processing system 400 (i.e., input devices and output devices). For example, an input device may include one or more pointing and/or information-input devices such as a keyboard, a mouse, a trackball, stylus, touch pad or touch screen, microphone, joystick, game pad, satellite dish, scanner, TV tuner card, digital camera, digital video camera, web camera, and/or the like. These and other input devices may connect to processor unit 404 through system bus 402 via interface port(s). Suitable interface port(s) may include, for example, a serial port, a parallel port, a game port, and/or a universal serial bus (USB).

One or more output devices may use some of the same types of ports, and in some cases the same actual ports, as the input device(s). For example, a USB port may be used to provide input to data processing system 400 and to output information from data processing system 400 to an output device. One or more output adapters may be provided for certain output devices (e.g., monitors, speakers, and printers, among others) which require special adapters. Suitable output adapters may include, e.g. video and sound cards that provide a means of connection between the output device and system bus 402. Other devices and/or systems of devices may provide both input and output capabilities, such as remote computer(s) 460. Display 414 may include any suitable human-machine interface or other mechanism configured to display information to a user, e.g., a CRT, LED, or LCD monitor or screen, etc.

Communications unit 410 refers to any suitable hardware and/or software employed to provide for communications with other data processing systems or devices. While communication unit 410 is shown inside data processing system 400, it may in some examples be at least partially external to data processing system 400. Communications unit 410 may include internal and external technologies, e.g., modems (including regular telephone grade modems, cable modems, and DSL modems), ISDN adapters, and/or wired and wireless Ethernet cards, hubs, routers, etc. Data processing system 400 may operate in a networked environment, using logical connections to one or more remote computers 460. A remote computer(s) 460 may include a personal computer (PC), a server, a router, a network PC, a workstation, a microprocessor-based appliance, a peer device, a smart phone, a tablet, another network note, and/or the like. Remote computer(s) 460 typically include many of the elements described relative to data processing system 400. Remote computer(s) 460 may be logically connected to data processing system 400 through a network interface 462 which is connected to data processing system 400 via communications unit 410. Network interface 462 encompasses wired and/or wireless communication networks, such as local-area networks (LAN), wide-area networks (WAN), and cellular networks. LAN technologies may include Fiber Distributed Data Interface (FDDI), Copper Distributed Data Interface (CDDI), Ethernet, Token Ring, and/or the like. WAN technologies include point-to-point links, circuit switching networks (e.g., Integrated Services Digital networks (ISDN) and variations thereon), packet switching networks, and Digital Subscriber Lines (DSL).

Codec 430 may include an encoder, a decoder, or both, comprising hardware, software, or a combination of hardware and software. Codec 430 may include any suitable device and/or software configured to encode, compress, and/or encrypt a data stream or signal for transmission and storage, and to decode the data stream or signal by decoding, decompressing, and/or decrypting the data stream or signal (e.g., for playback or editing of a video). Although codec 430 is depicted as a separate component, codec 430 may be contained or implemented in memory, e.g., non-volatile memory 442.

Non-volatile memory 442 may include read only memory (ROM), programmable ROM (PROM), electrically programmable ROM (EPROM), electrically erasable programmable ROM (EEPROM), flash memory, and/or the like, or any combination of these. Volatile memory 440 may include random access memory (RAM), which may act as external cache memory. RAM may comprise static RAM (SRAM), dynamic RAM (DRAM), synchronous DRAM (SDRAM), double data rate SDRAM (DDR SDRAM), enhanced SDRAM (ESDRAM), and/or the like, or any combination of these.

Instructions for the operating system, applications, and/or programs may be located in storage devices 416, which are in communication with processor unit 404 through system bus 402. In these illustrative examples, the instructions are in a functional form in persistent storage 408. These instructions may be loaded into memory 406 for execution by processor unit 404. Processes of one or more embodiments of the present disclosure may be performed by processor unit 404 using computer-implemented instructions, which may be located in a memory, such as memory 406.

These instructions are referred to as program instructions, program code, computer usable program code, or computer-readable program code executed by a processor in processor unit 404. The program code in the different embodiments may be embodied on different physical or computer-readable storage media, such as memory 406 or persistent storage 408. Program code 418 may be located in a functional form on computer-readable media 420 that is selectively removable and may be loaded onto or transferred to data processing system 400 for execution by processor unit 404. Program code 418 and computer-readable media 420 form computer program product 422 in these examples. In one example, computer-readable media 420 may comprise computer-readable storage media 424 or computer-readable signal media 426.

Computer-readable storage media 424 may include, for example, an optical or magnetic disk that is inserted or placed into a drive or other device that is part of persistent storage 408 for transfer onto a storage device, such as a hard drive, that is part of persistent storage 408. Computer-readable storage media 424 also may take the form of a persistent storage, such as a hard drive, a thumb drive, or a flash memory, that is connected to data processing system 400. In some instances, computer-readable storage media 424 may not be removable from data processing system 400.

In these examples, computer-readable storage media 424 is a non-transitory, physical or tangible storage device used to store program code 418 rather than a medium that propagates or transmits program code 418. Computer-readable storage media 424 is also referred to as a computer-readable tangible storage device or a computer-readable physical storage device. In other words, computer-readable storage media 424 is media that can be touched by a person.

Alternatively, program code 418 may be transferred to data processing system 400, e.g., remotely over a network, using computer-readable signal media 426. Computer-readable signal media 426 may be, for example, a propagated data signal containing program code 418. For example, computer-readable signal media 426 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 418 may be downloaded over a network to persistent storage 408 from another device or data processing system through computer-readable signal media 426 for use within data processing system 400. For instance, program code stored in a computer-readable storage medium in a server data processing system may be downloaded over a network from the server to data processing system 400. The computer providing program code 418 may be a server computer, a client computer, or some other device capable of storing and transmitting program code 418.

In some examples, program code 418 may comprise an operating system (OS) 450. Operating system 450, which may be stored on persistent storage 408, controls and allocates resources of data processing system 400. One or more applications 452 take advantage of the operating system's management of resources via program modules 454, and program data 456 stored on storage devices 416. OS 450 may include any suitable software system configured to manage and expose hardware resources of computer 400 for sharing and use by applications 452. In some examples, OS 450 provides application programming interfaces (APIs) that facilitate connection of different type of hardware and/or provide applications 452 access to hardware and OS services. In some examples, certain applications 452 may provide further services for use by other applications 452, e.g., as is the case with so-called "middleware." Aspects of present disclosure may be implemented with respect to various operating systems or combinations of operating systems.

The different components illustrated for data processing system 400 are not meant to provide architectural limitations to the manner in which different embodiments may be implemented. One or more embodiments of the present disclosure may be implemented in a data processing system that includes fewer components or includes components in addition to and/or in place of those illustrated for computer 400. Other components shown in FIG. 4 can be varied from the examples depicted. Different embodiments may be implemented using any hardware device or system capable of running program code. As one example, data processing system 400 may include organic components integrated with inorganic components and/or may be comprised entirely of organic components (excluding a human being). For example, a storage device may be comprised of an organic semiconductor.

In some examples, processor unit 404 may take the form of a hardware unit having hardware circuits that are specifically manufactured or configured for a particular use, or to produce a particular outcome or progress. This type of hardware may perform operations without needing program code 418 to be loaded into a memory from a storage device to be configured to perform the operations. For example, processor unit 404 may be a circuit system, an application specific integrated circuit (ASIC), a programmable logic device, or some other suitable type of hardware configured (e.g., preconfigured or reconfigured) to perform a number of operations. With a programmable logic device, for example, the device is configured to perform the number of operations and may be reconfigured at a later time. Examples of programmable logic devices include, a programmable logic array, a field programmable logic array, a field programmable gate array (FPGA), and other suitable hardware devices. With this type of implementation, executable instructions (e.g., program code 418) may be implemented as hardware, e.g., by specifying an FPGA configuration using a hardware description language (HDL) and then using a resulting binary file to (re)configure the FPGA.

In another example, data processing system 400 may be implemented as an FPGA-based (or in some cases ASIC-based), dedicated-purpose set of state machines (e.g., Finite State Machines (FSM)), which may allow critical tasks to be isolated and run on custom hardware. Whereas a processor such as a CPU can be described as a shared-use, general purpose state machine that executes instructions provided to it, FPGA-based state machine(s) are constructed for a special purpose, and may execute hardware-coded logic without sharing resources. Such systems are often utilized for safety-related and mission-critical tasks.

In still another illustrative example, processor unit 404 may be implemented using a combination of processors found in computers and hardware units. Processor unit 404 may have a number of hardware units and a number of processors that are configured to run program code 418. With this depicted example, some of the processes may be implemented in the number of hardware units, while other processes may be implemented in the number of processors.

In another example, system bus 402 may comprise one or more buses, such as a system bus or an input/output bus. Of course, the bus system may be implemented using any suitable type of architecture that provides for a transfer of data between different components or devices attached to the bus system. System bus 402 may include several types of bus structure(s) including memory bus or memory controller, a peripheral bus or external bus, and/or a local bus using any variety of available bus architectures (e.g., Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI)).

Additionally, communications unit 410 may include a number of devices that transmit data, receive data, or both transmit and receive data. Communications unit 410 may be, for example, a modem or a network adapter, two network adapters, or some combination thereof. Further, a memory may be, for example, memory 406, or a cache, such as that found in an interface and memory controller hub that may be present in system bus 402.

D. Illustrative Distributed Data Processing System

Figure 5:
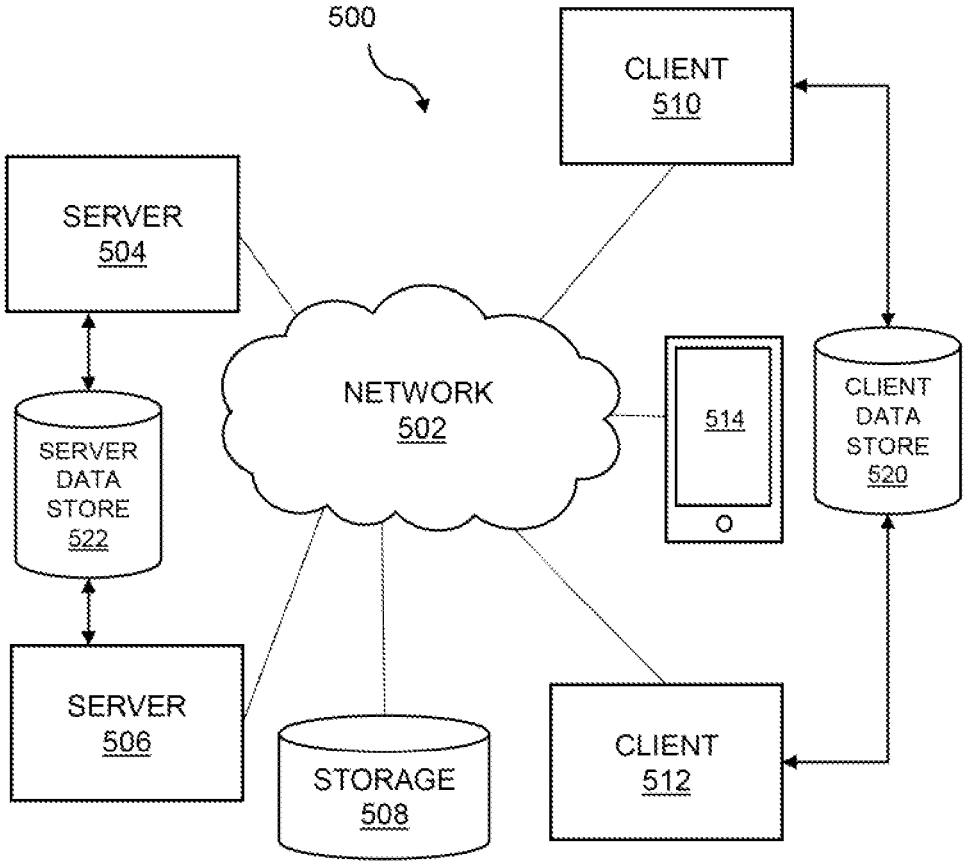
FIG. 5 is a schematic diagram depicting a general network data processing system in accordance with aspects of the present disclosure.

As shown in FIG. 5, this example describes a general network data processing system 500, interchangeably termed a computer network, a network system, a distributed data processing system, or a distributed network, aspects of which may be included in one or more illustrative embodiments of household appliances described herein. For example, controllers included in household appliances (e.g., household appliance 100) may communicate with a user's portable electronic devices over a network. A user may utilize a portable electronic device to control functions of household appliances described herein, such as by changing a cooking temperature of the household appliance, switching on a camera included in the household appliance, and/or the like.

It should be appreciated that FIG. 5 is provided as an illustration of one implementation and is not intended to imply any limitation with regard to environments in which different embodiments may be implemented. Many modifications to the depicted environment may be made.

Network system 500 is a network of devices (e.g., computers), each of which may be an example of data processing system 400, and other components. Network data processing system 500 may include network 502, which is a medium configured to provide communications links between various devices and computers connected within network data processing system 500. Network 502 may include connections such as wired or wireless communication links, fiber optic cables, and/or any other suitable medium for transmitting and/or communicating data between network devices, or any combination thereof.

In the depicted example, a first network device 504 and a second network device 506 connect to network 502, as do one or more computer-readable memories or storage devices 508. Network devices 504 and 506 are each examples of data processing system 400, described above. In the depicted example, devices 504 and 506 are shown as server computers, which are in communication with one or more server data store(s) 522 that may be employed to store information local to server computers 504 and 506, among others. However, network devices may include, without limitation, one or more personal computers, mobile computing devices such as personal digital assistants (PDAs), tablets, and smartphones, handheld gaming devices, wearable devices, tablet computers, routers, switches, voice gates, servers, electronic storage devices, imaging devices, media players, and/or other networked-enabled tools that may perform a mechanical or other function. These network devices may be interconnected through wired, wireless, optical, and other appropriate communication links.

In addition, client electronic devices 510 and 512 and/or a client smart device 514, may connect to network 502. Each of these devices is an example of data processing system 400, described above regarding FIG. 4. Client electronic devices 510, 512, and 514 may include, for example, one or more personal computers, network computers, and/or mobile computing devices such as personal digital assistants (PDAs), smart phones, handheld gaming devices, wearable devices, and/or tablet computers, and the like. In the depicted example, server 504 provides information, such as boot files, operating system images, and applications to one or more of client electronic devices 510, 512, and 514. Client electronic devices 510, 512, and 514 may be referred to as "clients" in the context of their relationship to a server such as server computer 504. Client devices may be in communication with one or more client data store(s) 520, which may be employed to store information local to the clients (e.g., cookie(s) and/or associated contextual information). Network data processing system 500 may include more or fewer servers and/or clients (or no servers or clients), as well as other devices not shown.

In some examples, first client electric device 510 may transfer an encoded file to server 504. Server 504 can store the file, decode the file, and/or transmit the file to second client electric device 512. In some examples, first client electric device 510 may transfer an uncompressed file to server 504 and server 504 may compress the file. In some examples, server 504 may encode text, audio, and/or video information, and transmit the information via network 502 to one or more clients.

Client smart device 514 may include any suitable portable electronic device capable of wireless communications and execution of software, such as a smartphone or a tablet. Generally speaking, the term "smartphone" may describe any suitable portable electronic device configured to perform functions of a computer, typically having a touchscreen interface, Internet access, and an operating system capable of running downloaded applications. In addition to making phone calls (e.g., over a cellular network), smartphones may be capable of sending and receiving emails, texts, and multimedia messages, accessing the Internet, and/or functioning as a web browser. Smart devices (e.g., smartphones) may include features of other known electronic devices, such as a media player, personal digital assistant, digital camera, video camera, and/or global positioning system. Smart devices (e.g., smartphones) may be capable of connecting with other smart devices, computers, or electronic devices wirelessly, such as through near field communications (NFC), BLUETOOTH®, WiFi, or mobile broadband networks. Wireless connectively may be established among smart devices, smartphones, computers, and/or other devices to form a mobile network where information can be exchanged.

Data and program code located in system 500 may be stored in or on a computer-readable storage medium, such as network-connected storage device 508 and/or a persistent storage 408 of one of the network computers, as described above, and may be downloaded to a data processing system or other device for use. For example, program code may be stored on a computer-readable storage medium on server computer 504 and downloaded to client 510 over network 502, for use on client 510. In some examples, client data store 520 and server data store 522 reside on one or more storage devices 508 and/or 408.

Network data processing system 500 may be implemented as one or more of different types of networks. For example, system 500 may include an intranet, a local area network (LAN), a wide area network (WAN), or a personal area network (PAN). In some examples, network data processing system 500 includes the Internet, with network 502 representing a worldwide collection of networks and gateways that use the transmission control protocol/Internet protocol (TCP/IP) suite of protocols to communicate with one another. At the heart of the Internet is a backbone of high-speed data communication lines between major nodes or host computers. Thousands of commercial, governmental, educational and other computer systems may be utilized to route data and messages. In some examples, network 502 may be referred to as a "cloud." In those examples, each server 504 may be referred to as a cloud computing node, and client electronic devices may be referred to as cloud consumers, or the like. FIG. 5 is intended as an example, and not as an architectural limitation for any illustrative embodiments.

E. Illustrative Combinations and Additional Examples

This section describes additional aspects and features of household appliances including reflective doors, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A household appliance comprising:

a housing defining an oven cavity;

a door pivotably coupled to the housing such that the door is configured to open and close an opening to the cavity, the door including a window comprising partially reflective glass;

a camera coupled to an inner wall of the housing inside the oven cavity such that the camera faces the opening; and a lamp disposed within the oven cavity and configured to illuminate the oven cavity;

wherein the lamp and the camera are interlocked such that the camera is operable only when the lamp illuminates the oven cavity.

A1. The household appliance of paragraph A0, wherein the lamp and the camera are coupled to an electronic controller configured to switch the light and the camera between "on" and "off" states.

A2. The household appliance of paragraph A0 or A1, wherein an inner surface of the window facing the oven cavity when the door is in a closed position includes a partially reflective coating.

A3. The household appliance of any of paragraphs A0 through A2, wherein an outer surface of the window facing an exterior environment includes a partially reflective coating.

A4. The household appliance of any of paragraphs A0 through A3, wherein the window is configured to reflect heat into the oven cavity.

A5. The household appliance of any of paragraphs A0 through A4, wherein the window is coated on at least one surface with aluminum.

A6. The household appliance of any of paragraphs A0 through A5, wherein the camera is further configured to operate only when the door is in a closed position.

B0. A household appliance comprising:

a housing defining an oven cavity and including a door pivotably coupled to a front surface of the housing such that the door is configured to selectively open and close the cavity;

a window disposed in the door, the window comprising partially reflective glass configured to reflect light traveling out of the cavity into a surrounding room and to transmit light traveling into the cavity from the surrounding room;

a camera disposed within the oven cavity; and a light configured to illuminate the oven cavity;

wherein the camera and the light are interlocked such that the camera is only powered when the light is powered.

B1. The household appliance of paragraph B0, wherein the light and the camera are electrically coupled to a controller configured to switch the light and the camera between "on" and "off" states.

B2. The household appliance of paragraph B0 or B1, wherein a first side of the window includes a first partially reflective coating applied in a first layer thickness.

B3. The household appliance of any of paragraphs B0 through B2, wherein a second side of the window includes a second partially reflective coating applied in a second layer thickness, and wherein the second layer thickness is less than the first layer thickness.

B4. The household appliance of any of paragraphs B0 through B3, wherein the window is configured to reflect heat within the oven cavity.

B5. The household appliance of any of paragraphs B0 through B4, wherein the window is coated on at least one side with aluminum.

B6. The household appliance of any of paragraphs B0 through B5, wherein the camera is configured to operate only when the door is in the closed position.

C0. A household appliance comprising:

a housing defining an oven cavity;

a door pivotably coupled to a front surface of the housing and configured to obscure an opening of the oven cavity when the door is in a closed configuration;

a window received within a recess disposed within the door, the window comprising partially reflective glass configured to reflect light traveling in a first direction and transmit light traveling in a second direction;

a camera disposed within the oven cavity;

a light configured to illuminate the oven cavity; and a controller configured to activate the camera only if the household appliance is on, the door of the household appliance is closed, and the light is on.

C1. The household appliance of paragraph C0, wherein the light and the camera are electrically coupled such that the camera is only powered when the light is powered.

C2. The household appliance of paragraph C0 or C1, wherein a first side of the window includes a partially reflective coating applied in a first layer thickness.

C3. The household appliance of any of paragraphs C0 through C2, wherein a second side of the window includes a partially reflective coating applied in a second layer thickness, and wherein the second layer thickness is less than the first layer thickness.

C4. The household appliance of any of paragraphs C0 through C3, wherein the window comprising partially reflective glass is configured to retain heat within the oven cavity.

C5. The household appliance of any of paragraphs C0 through C4, wherein the window is coated on at least one side with aluminum.

Advantages, Features, and Benefits

The different embodiments and examples of the household appliance described herein provide several advantages over known solutions for capturing video within an oven cavity. For example, illustrative embodiments and examples described herein allow a camera disposed within an oven cavity to be mounted to a back wall of the oven cavity without recording portions of a user's house or activities outside of the oven.

Additionally, and among other benefits, illustrative embodiments and examples described herein allow improved 3D viewing of the oven cavity, as the reflective oven door provides a back view of objects captured by the camera.

Additionally, and among other benefits, illustrative embodiments and examples described herein improve heat retention within the oven, as the reflective door reflects heat back toward the inside of the oven cavity.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A household appliance comprising:

a housing defining an oven cavity;

a door pivotably coupled to the housing such that the door is configured to open and close an opening to the cavity, the door including a window comprising partially reflective glass;

a camera coupled to an inner wall of the housing inside the oven cavity such that the camera faces the opening; and one or more lamps disposed within the oven cavity and configured to illuminate the oven cavity;

wherein the one or more lamps, the door, and the camera are interlocked such that the camera is activated only when the door is closed and the one or more lamps illuminate the oven cavity, and the camera is automatically deactivated otherwise; and wherein the partially reflective glass comprises a one-way mirrored surface configured to be reflective to visible light on a first side facing the oven cavity and transparent to visible light on a second side facing an exterior environment when the one or more lamps illuminate the oven cavity.

2. The household appliance of claim 1, wherein the one or more lamps and the camera are coupled to an electronic controller configured to switch the one or more lamps and the camera between "on" and "off" states.

3. The household appliance of claim 1, wherein an inner surface of the window facing the oven cavity when the door is in a closed position includes a partially reflective coating.

4. The household appliance of claim 3, wherein an outer surface of the window facing the exterior environment includes a partially reflective coating.

5. The household appliance of claim 1, wherein the window is configured to reflect heat into the oven cavity.

6. The household appliance of claim 1, wherein the window is coated on at least one surface with aluminum.

7. A household appliance comprising:

a housing defining an oven cavity and including a door pivotably coupled to a front surface of the housing such that the door is configured to selectively open and close the cavity;

a window disposed in the door, the window comprising a one-way mirrored surface;

a camera disposed within the oven cavity; and a light configured to illuminate the oven cavity with visible light;

wherein the camera, the door, and the light are interlocked such that the camera is only powered when the door is closed and the light is powered, and the camera is automatically unpowered otherwise; and when the light is powered, the one-way mirrored surface is configured to be reflective to visible light on a first side facing the oven cavity and transparent to visible light on a second side facing a surrounding room.

8. The household appliance of claim 7, wherein the light and the camera are electrically coupled to a controller configured to switch the light and the camera between "on" and "off" states.

9. The household appliance of claim 7, wherein a first side of the window includes a first partially reflective coating applied in a first layer thickness.

10. The household appliance of claim 9, wherein a second side of the window includes a second partially reflective coating applied in a second layer thickness, and wherein the second layer thickness is less than the first layer thickness.

11. The household appliance of claim 7, wherein the window is configured to reflect heat within the oven cavity.

12. The household appliance of claim 7, wherein the window is coated on at least one side with aluminum.

13. A household appliance comprising:

a housing defining an oven cavity;

a door pivotably coupled to a front surface of the housing and configured to obscure an opening of the oven cavity when the door is in a closed configuration;

a window received within a recess disposed within the door, the window comprising partially reflective glass configured to reflect visible light traveling in a first direction and transmit visible light traveling in a second direction;

a camera disposed within the oven cavity;

a light configured to illuminate the oven cavity; and a controller configured to activate the camera only if the household appliance is on, the door of the household appliance is closed, and the light is on, and further configured to automatically deactivate the camera when the door is open or the light is off;

wherein the partially reflective glass comprises a one-way mirrored surface.

14. The household appliance of claim 13, wherein the light and the camera are electrically coupled such that the camera is only powered when the light is powered.

15. The household appliance of claim 13, wherein a first side of the window includes a partially reflective coating applied in a first layer thickness.

16. The household appliance of claim 15, wherein a second side of the window includes a partially reflective coating applied in a second layer thickness, and wherein the second layer thickness is less than the first layer thickness.

17. The household appliance of claim 13, wherein the window comprising partially reflective glass is configured to retain heat within the oven cavity.

18. The household appliance of claim 13, wherein the window is coated on at least one side with aluminum.

* * * * *